United States Patent [19]

Kubota

[11] 4,137,840

[45] Feb. 6, 1979

[54] MECHANICAL PRESS HAVING TWIN WORKING STATIONS

[75] Inventor: Ichiro Kubota, Asaka, Japan

[73] Assignee: Kabushiki Kaisha Komatsu Seisakusho, Tokyo, Japan

[21] Appl. No.: 876,832

[22] Filed: Feb. 10, 1978

[30] Foreign Application Priority Data

Feb. 9, 1977 [JP] Japan ..... 52-12407

[51] Int. Cl.[2] ..... B30B 15/12

[52] U.S. Cl. ..... 100/209; 72/450; 72/455; 83/513; 83/618; 100/257; 100/282

[58] Field of Search ..... 100/208, 209, 282, 231, 100/257, 207; 83/513, 518, 519, 618; 72/450, 455; D15/123

[56] References Cited

U.S. PATENT DOCUMENTS 235,001 11/1880 Miller ..... 100/209

3,779,155 12/1973 Ohno ..... 100/207

FOREIGN PATENT DOCUMENTS 2043619 3/1972 Fed. Rep. of Germany ..... 100/214

844611 8/1960 United Kingdom ..... 100/208

*Primary Examiner*—Billy J. Wilhite

*Attorney, Agent, or Firm*—Armstrong, Nikaido, Marmelstein & Kubovcik

[57] ABSTRACT

A mechanical press having twin working stations comprising a bed, a pair of bolsters mounted on both sides of said bed, four uprights extending upwardly from said bed, a frame structure mounted on said uprights, said frame structure having a pair of guide portions defined at both ends thereof, and a pair of slides slidably mounted in the respective guide portion of said frame structure, each of said slide structures being adapted to face with each of said bolsters.

4 Claims, 6 Drawing Figures

MECHANICAL PRESS HAVING TWIN WORKING STATIONS

BACKGROUND OF THE INVENTION

This invention relates to a mechanical press, and more particularly to a mechanical press comprising bolsters having upper surfaces which are open in three directions.

As for the press of the kind specified, there has been employed C-frame press comprising a C-shaped body having an opening formed therein, a bolster located on the lower end of said opening and a slide mounted on the upper end of said opening so as to move up and down freely opposite to the bolster.

The press of such construction is advantageous in that the upper surface of the bolster is open in three directions to ensure efficient press operation; however, it is disadvantageous in that the strength of the press body is reduced because the upper surface of the bolster is open in three directions and therefore increase of the width "t" of the press body is required thus increasing the space required for installation thereof. In particular, when a plurality of presses are juxtaposed to achieve efficient press operation, there is encountered a difficulty that a very wide space is required for installation of the presses.

SUMMARY OF THE INVENTION

It is therefore an object of the present invention to provide an improved mechanical press having twin working stations.

Another object of the present invention is to provide a mechanical press having twin working stations which requires a relatively small space for installation.

In accordance with an aspect of the present invention, there is provided a mechanical press having twin working stations comprising a bed, a pair of bolsters mounted on both side ends of said bed, respectively, four column means extending upwardly from said bed, and frame means mounted on said column means, said frame means having a pair of guide portions defined at both ends thereof.

A pair of slide means are slidably mounted in the respective guide portions of said frame means, each of said slide means being adapted to face with each of said bolsters so as to provide power stations therebetween.

A transmission means is provided in the frame means so as to operatively connect a drive means with said pair of slide means, said transmission means including a pair of clutch means wherein stroke phases of said pair of slide means can be varied with each other by adjusting the clutch means relative to each other.

The above and other objects, features and advantages of the present invention will be readily apparent from the following description taken in conjunction with the accompanying drawings.

DESCRIPTION OF THE PREFERRED EMBODIMENTS

Figure 1:
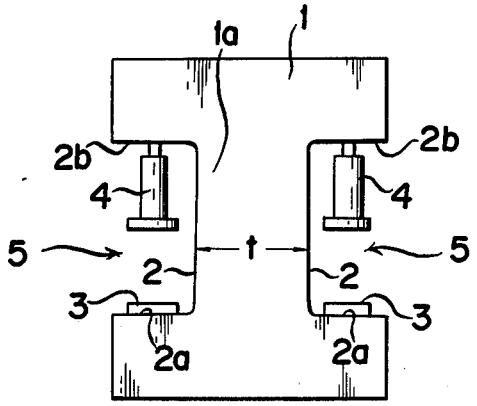
FIG. 1 is a schematic illustration showing a press arrangement according to the present invention.
Figure 2:
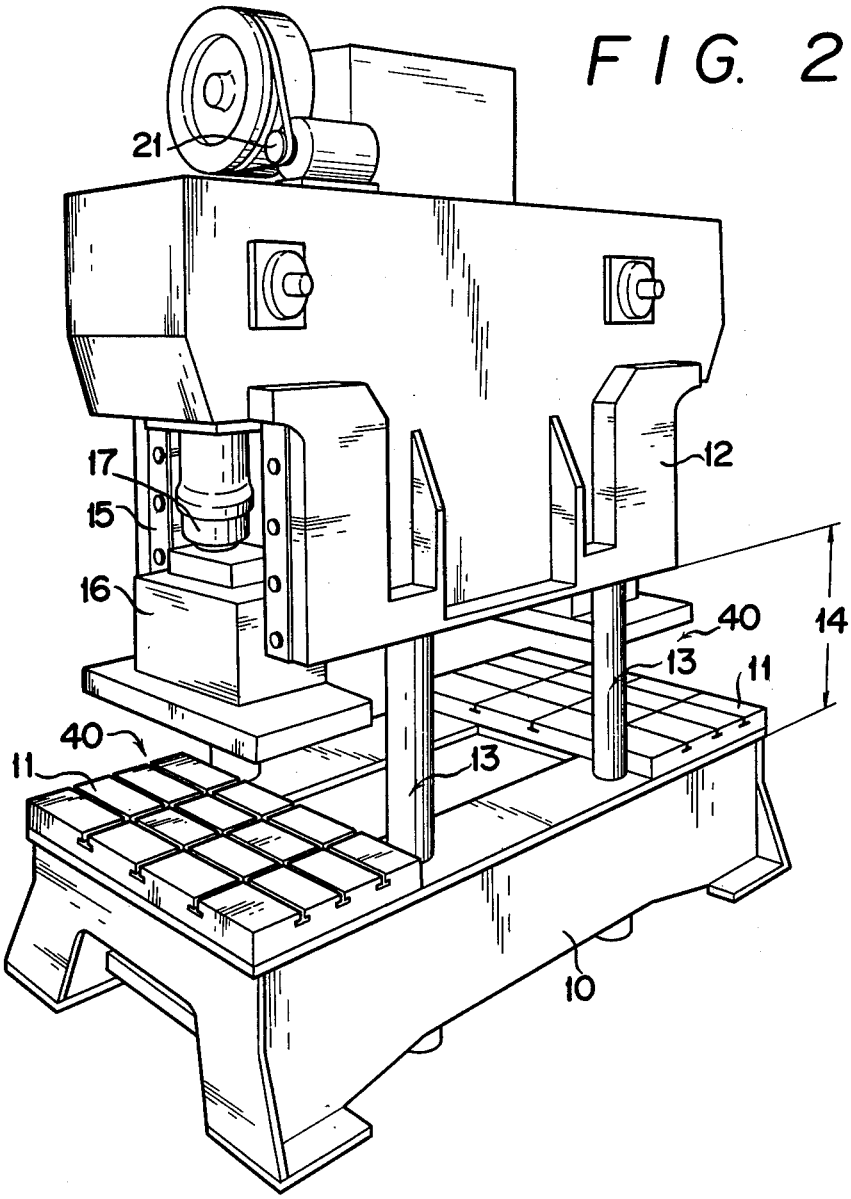
FIG. 2 is a perspective view of the present invention.

Reference numeral 1 denotes a press body constituting a frame having recesses 2, 2 formed on both sides thereof. A bolster 3 is mounted on the lower end **2*a* of each recess 2, whilst a slide 4 is mounted on the upper end 2*b* of each recess 2. Therefore, a pair of press working stations 5, 5 each having a bolster 3 and a slide 4 are installed on both sides of the press body 1**.

Since the press is constructed as mentioned above, thinner wall portion **1*a* of the press body 1 is required to have a width "t" enough to withstand the load imposed by the press working station 5 comprising a bolster 3 and a slide 4** during press working, and therefore the overall space for installation of the press can be made smaller than that required for installation of two sets of independent presses.

Further, because of provision of a pair of press working stations 5, 5 on both sides of the press body 1, the press work can be achieved efficiently by two sets of presses.

Preferred embodiments of the present invention will now be described below with reference to FIGS. 2 to 6.

A pair of bolsters 11, 11 are mounted on both sides of a bed 10. A frame 12 is installed above the bed 10 through connection means or column means 13 located at four corners so as to define a clearance 14 therebetween.

Formed on both sides of the frame 12 are longitudinal guide grooves 15 in each of which a slide 16 is mounted slidably in the vertical direction, each slide 16 being connected to a plunger 17.

Figure 3:
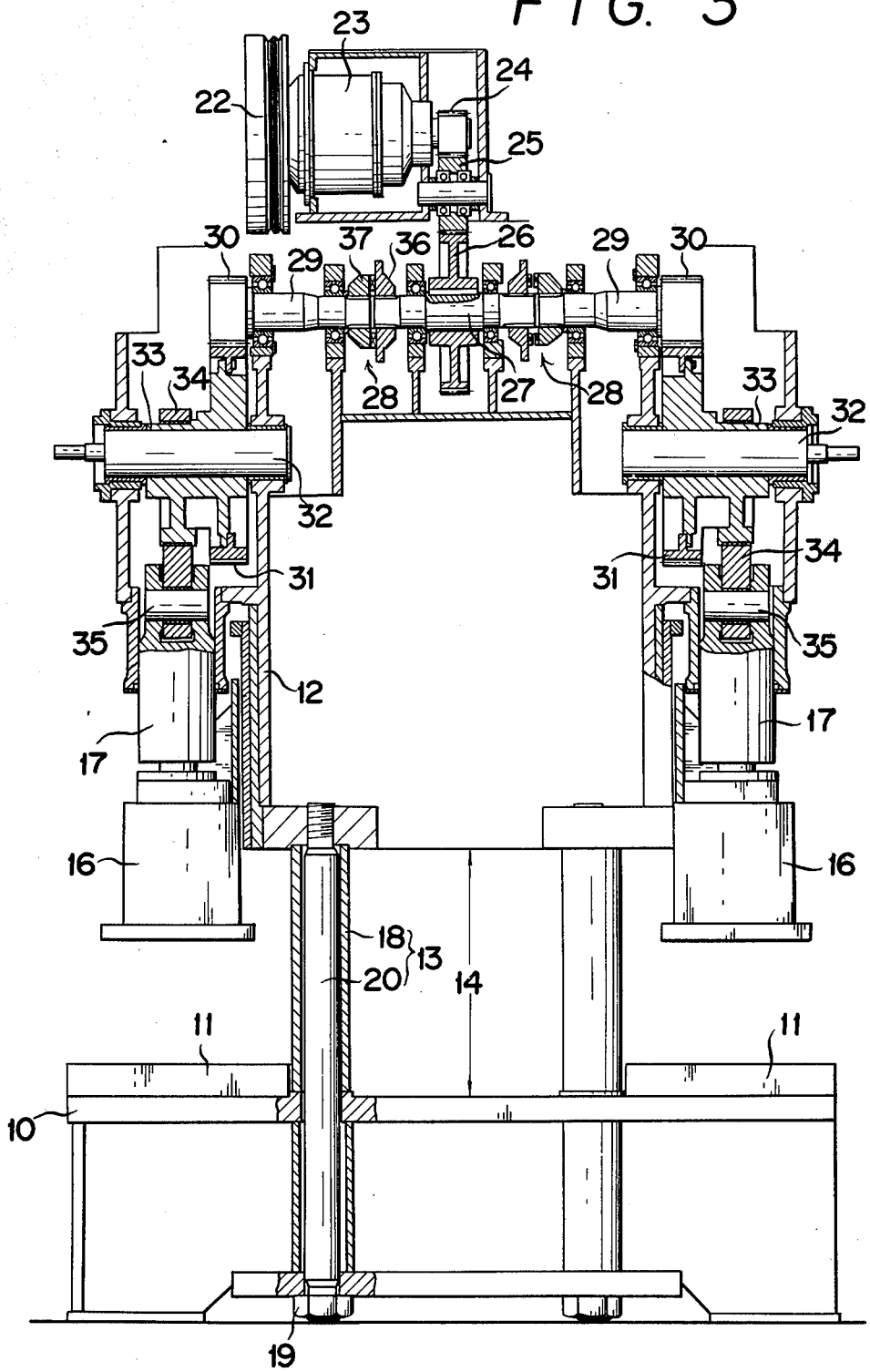
FIG. 3 is a longitudinal cross-sectional view of the present invention.

The above-mentioned connection means 13 comprises, as shown in FIG. 3, a plurality of compression tubes 18 located between the bed 10 and the frame 12, each compression tube 18 having a tie rod 20 which is inserted therein, threadably engaged with the bed 10 and tightened up thereto by means of a nut 19. The clearance 14 between the bed 10 and the frame 12 can be altered or adjusted by altering the length of the compression tubes 18 and tie rods 20.

Reference numeral 21 denotes an electric motor fixedly secured on the upper end of the frame 12. The motor 21 is operatively connected through a flywheel 22, and a unit 23 which comprises a clutch and a brake to a pinion gear 24 which is engaged in turn through an idle gear 25 with a drive gear 26. Reference numeral 27 indicates a drive shaft, both ends of which are connected, respectively, through a clutch mechanism 28 with a driven shaft 29. The power from each of the driven shafts 29 is transmitted through a first main pinion gear 30, a second main pinion gear 31 and a shaft 32 to an eccentric drum 33. A connecting rod 34 is fitted from outside to each of the eccentric drums 33. Each of the connecting rods 34 is pivotally connected to each of the aforementioned plungers 17 by means of a pin 35.

Figure 4:
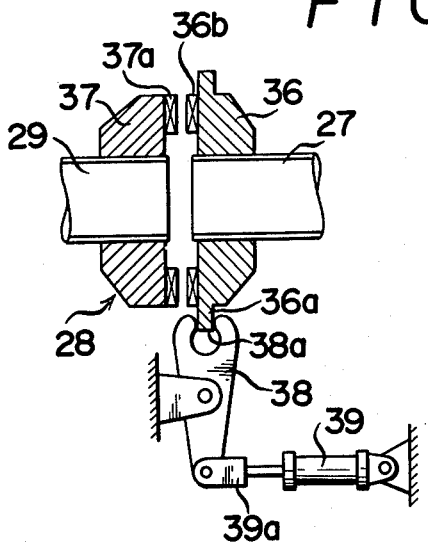
FIG. 4 is an explanatory view partially in cross-section of clutch means according to the present invention.

Each of the above-mentioned clutch mechanisms 28 comprises, as shown in FIG. 4, a movable engaging clutch plate 36 in which the drive shaft 27 is fitted by spline, and a fixed engaging clutch plate 37 fixedly secured to the driven shaft 29, said movable engaging clutch plate 36 having a flange **36*a* to which bifurcated portion 38*a* of an oscillating lever 38 is fitted from outside, said oscillating lever 38 being pivotally connected to movable member 39*a* of a cylinder 39. Further, the movable engaging clutch plate 36 and the fixed engaging clutch plate 37 have a plurality of annular tooth portions 36***b* and 37*a* formed thereon at equal intervals, respectively, so that their engaging positions can be altered or adjusted circumferentially.

The operation of the press will now be described below.

When the motor 21 is driven, the pair of slides 16, 16 are moved up and down relative to each bolster 11 to enable the press work to be made on both sides of the press body.

Figure 5:
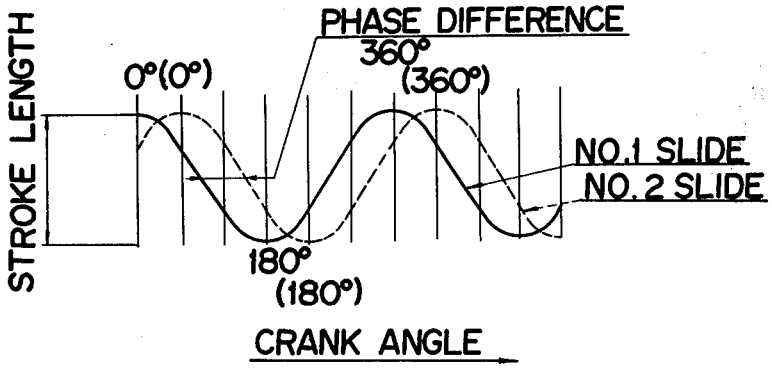
FIG. 5 is a diagram showing press motion cycles of slides according to the present invention.

In this case, if the engaging positions of the left and right hand engaging clutch mechanisms 28 are different so as to allow the driven shafts 29 to be brought out of rotational phases relative to each other, a phase difference is created in the period of pressing motions of the pair of slides 16 and 16 as shown in FIG. 5 in diagram.

For this reason, there occurs a difference in the maximum load application timing for the press working stations 40, 40 on both sides thereof so that the maximum load of the press working stations 40, 40 cannot be applied to the frame 12 at the same time. Therefore, the mechanical strength of the frame 12 can be made approximately equal to that of the frame of one set of the press, and as a result, the width "t" of the frame 12 can be made as narrow as that of the frame of one set of the press.

Further, if the oscillating lever 38 is oscillated by means of the cylinder 39 of the engaging clutch mechanism 28 so as to slidably move the movable engaging clutch plate 36 along the spline of the drive shaft 27 thereby disengaging the clutch, only the slide 16 on the other side can be moved up and down and utilized conveniently for die setting operation etc.

Moreover, one set of motor may be provided for driving each of the slides 16, 16 so as to enable the power of each motor to be transmitted to each of the slides.

Figure 6:
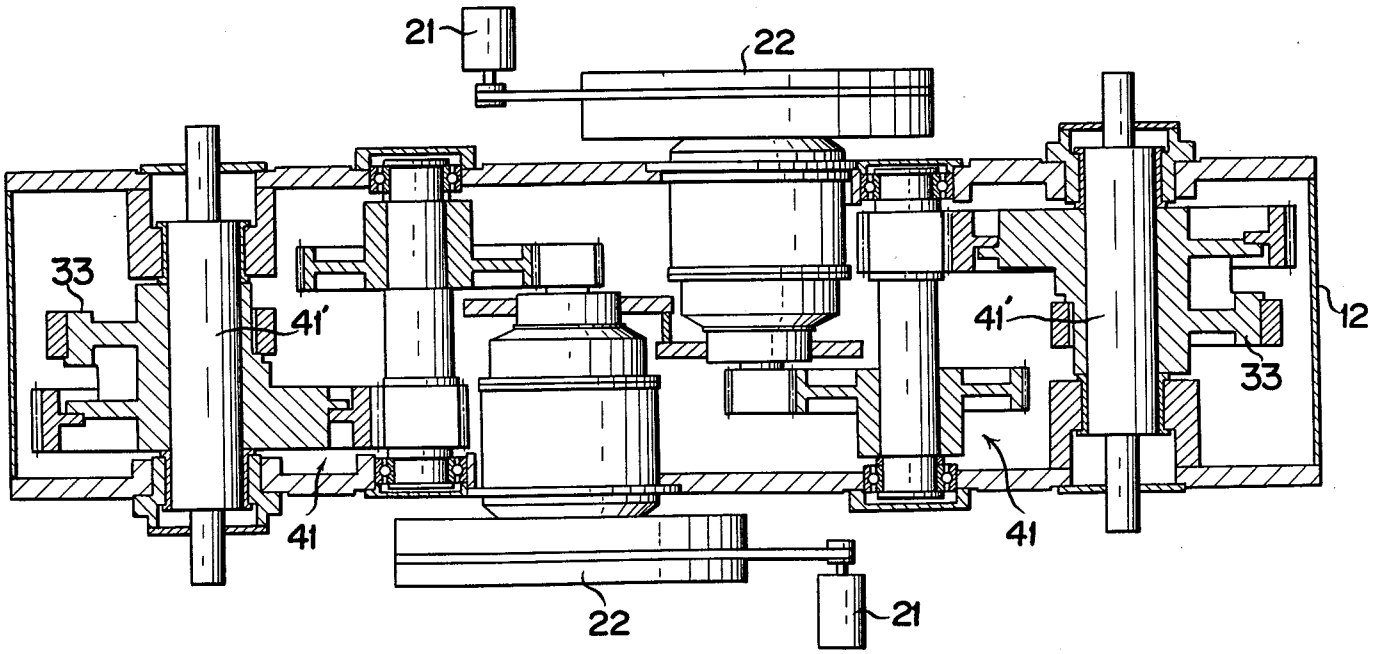
FIG. 6 is a plan view partially in cross-section of another embodiment of the present invention.

For example, as shown in FIG. 6, a pair of motors 21 may be provided to enable the power developed by each motor to be transmitted through a flywheel 22 and a power transmission mechanism 41 to each of slides 16, 16. In this case, since each of the left and right hand power transmission mechanisms 41 has a shaft 41', respectively, and so in case of operating a plurality of juxtaposed presses of this kind the power of the shaft 41' can be taken out.

Since the press of the present invention is constructed as mentioned hereinabove, it can provide a press function equivalent to those of two sets of presses and can be installed in a narrow space.

It is to be understood that the foregoing description is merely illustrative of the preferred embodiment of the invention and that the scope of the invention is not to be limited thereto, but is to be determined by the scope of the appended claims.

What is claimed is:

1. A mechanical press having twin working stations comprising a bed, a pair of bolsters mounted on both side ends of said bed, respectively, four column means extending upwardly from said bed, frame means mounted on said column means, said frame means having a pair of guide portions defined at both ends thereof, a pair of slide means slidably mounted in the respective guide portions of said frame means, each of said slide means being adapted to face with each of said bolsters, drive means mounted on said frame means, and transmission means operatively connecting said drive means with said pair of slide means, said transmission means including a pair of clutch means wherein stroke phases of said pair of slide means can be varied with each other by adjusting the clutch means relative to each other.

2. A mechanical press having twin working stations as defined in claim 1 wherein each of said column means comprises a tube, and a tie rod inserted in said tube wherein distance between said frame means and said bed can be adjustable by changing the length of said tube and tie rod.

3. A mechanical press having twin working stations as defined in claim 1 wherein said drive means includes a single power source.

4. A mechanical press having twin working stations as defined in claim 1 wherein said drive means includes two power sources and said transmission means is provided two sets so as to independently drive said pair of slide means.

* * * * *